US005619932A

United States Patent [19]

Efland et al.

[11] Patent Number: 5,619,932

[45] Date of Patent: Apr. 15, 1997

[54] VAULT FOR STORING COINS AND/OR TOKENS

[75] Inventors: Richard A. Efland, Escondido, Calif.; Lawrence Ames, Ramsey, N.J.

[73] Assignee: Cubic Toll Systems, Inc., Hauppauge, N.Y.

[21] Appl. No.: 129,435

[22] Filed: Sep. 30, 1993

[51] Int. Cl.[6] ..... G07G 5/00

[52] U.S. Cl. ..... 109/24.1; 109/45; 194/350; 221/197; 232/15

[58] Field of Search ..... 109/24.1, 45, 46, 109/53, 55; 70/63; 73/163; 232/15, 16; 221/2, 4, 197, 287; 271/145, 162, 163; 194/317, 318, 304, 306, 315, 217, 350, 334, DIG. 901

[56] References Cited

U.S. PATENT DOCUMENTS

| | | | |
|---|---|---|---|
| 4,372,478 | 2/1983 | Gomez et al. | 232/15 X |
| 4,380,316 | 4/1983 | Glinka et al. | 232/16 |
| 4,471,905 | 9/1984 | Sloma et al. | 232/15 X |
| 4,611,205 | 9/1986 | Eglise | 194/217 X |
| 4,785,969 | 11/1988 | McLaughlin | 221/197 X |
| 4,871,085 | 10/1989 | Graef et al. | 221/197 X |
| 4,955,532 | 9/1990 | Kanehara et al. | 232/16 X |
| 5,038,908 | 8/1991 | McGough | 194/350 |
| 5,224,579 | 7/1993 | Brown | 194/350 |
| 5,259,491 | 11/1993 | Ward, II | 194/350 |
| 5,337,253 | 8/1994 | Berkovsky et al. | 194/217 X |

FOREIGN PATENT DOCUMENTS

| | | | |
|---|---|---|---|
| 2527812 | 12/1983 | France | 194/DIG. 901 |

OTHER PUBLICATIONS

50 Ways to Touch Memory (Second Edition), Dallas Semiconductor, Oct. 1992.

Book of DS199X Touch Memory Standards, Dallas Semiconductor, Oct. 1992.

*Primary Examiner*—Suzanne L. Dino

*Attorney, Agent, or Firm*—Theodore F. Shiells

[57] ABSTRACT

A vault insertable into a coin and/or token collecting device and having a portion which is openable upon such insertion and closeable and lockable upon removal therefrom for storing coins and/or tokens received from the collecting device. The vault includes an electronic memory device for storing information relating to the vault, such as a vault serial number, and for supplying the vault information to the collecting device upon insertion of the vault into the collecting device. While the vault is contained within the collecting device, information from the collecting device may be supplied to the memory device for storage therein and information stored within the memory device may be supplied to the collecting device in response to a request signal from the collecting device.

17 Claims, 7 Drawing Sheets

FIG. 3
PRIOR ART
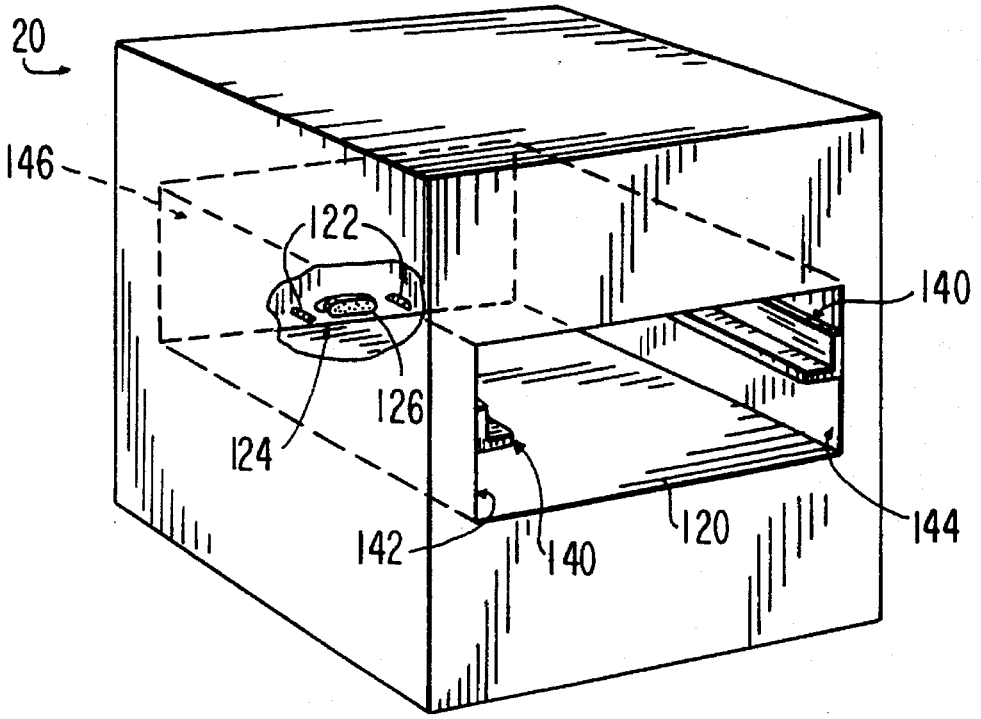
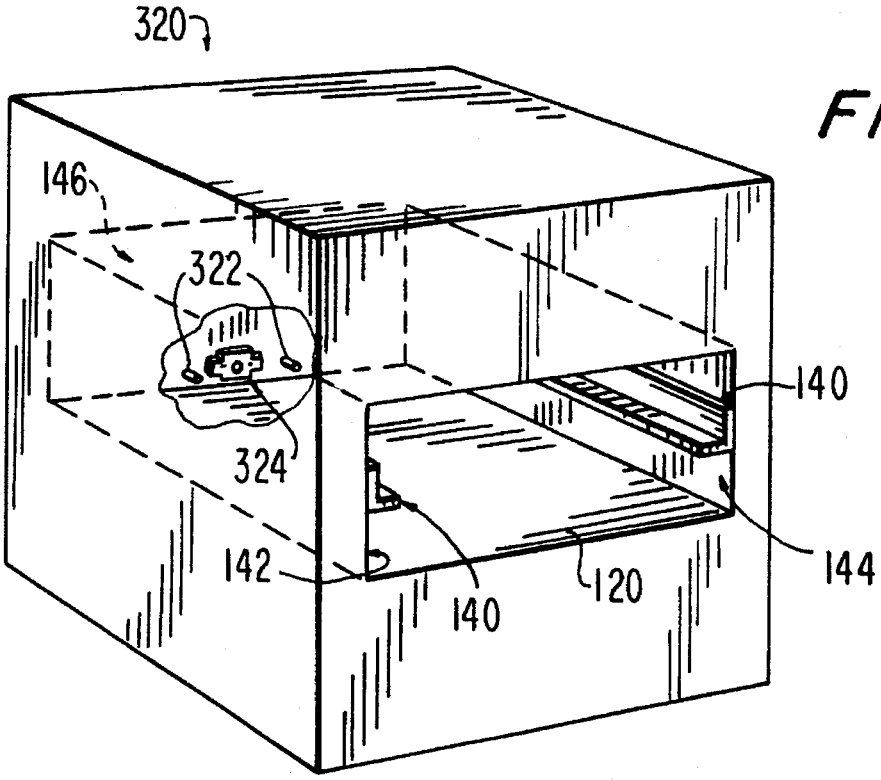
FIG.5

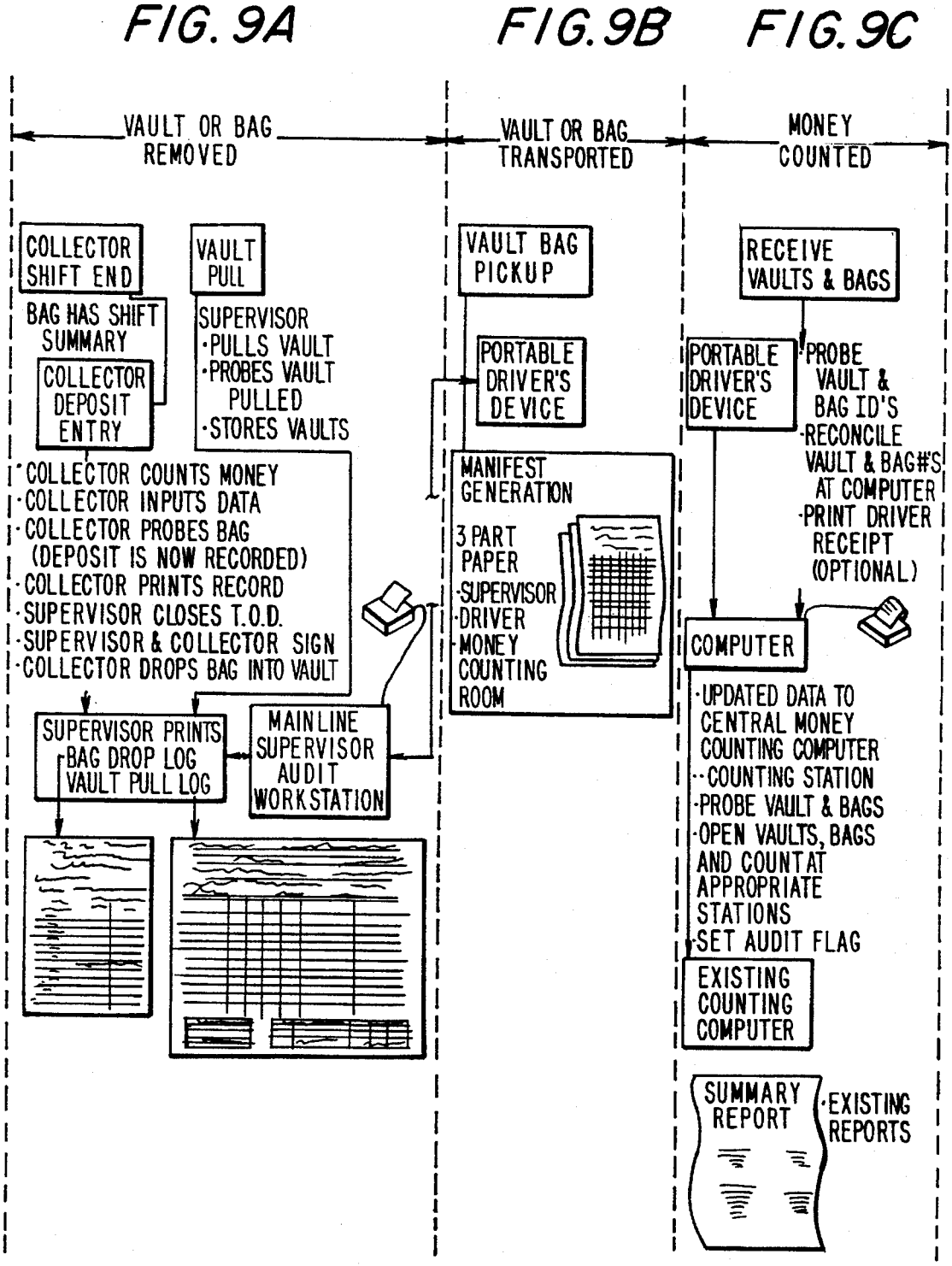
FIG. 9A
FIG. 9B
FIG. 9C
VAULT OR BAG REMOVED
VAULT OR BAG TRANSPORTED
MONEY COUNTED
COLLECTOR SHIFT END
VAULT PULL
BAG HAS SHIFT SUMMARY
COLLECTOR DEPOSIT ENTRY
SUPERVISOR
·PULLS VAULT
·PROBES VAULT PULLED
·STORES VAULTS
·COLLECTOR COUNTS MONEY
·COLLECTOR INPUTS DATA
·COLLECTOR PROBES BAG (DEPOSIT IS NOW RECORDED)
·COLLECTOR PRINTS RECORD
·SUPERVISOR CLOSES T.O.D.
·SUPERVISOR & COLLECTOR SIGN
·COLLECTOR DROPS BAG INTO VAULT
SUPERVISOR PRINTS BAG DROP LOG VAULT PULL LOG
MAINLINE SUPERVISOR AUDIT WORKSTATION
VAULT BAG PICKUP
PORTABLE DRIVER'S DEVICE
MANIFEST GENERATION
3 PART PAPER
·SUPERVISOR
·DRIVER
·MONEY COUNTING ROOM
RECEIVE VAULTS & BAGS
PORTABLE DRIVER'S DEVICE
·PROBE VAULT & BAG ID'S
·RECONCILE VAULT & BAG#'S AT COMPUTER
·PRINT DRIVER RECEIPT (OPTIONAL)
COMPUTER
·UPDATED DATA TO CENTRAL MONEY COUNTING COMPUTER
··COUNTING STATION
·PROBE VAULT & BAGS
·OPEN VAULTS, BAGS AND COUNT AT APPROPRIATE STATIONS
·SET AUDIT FLAG
EXISTING COUNTING COMPUTER
SUMMARY REPORT
·EXISTING REPORTS

VAULT FOR STORING COINS AND/OR TOKENS

BACKGROUND OF THE INVENTION

1. Field of the Invention

This invention relates to a vault for storing coins and/or tokens and, more particularly, to such a vault which is insertable into a coin and/or token collecting apparatus and which includes a memory device for storing information relating to the vault and for automatically supplying such information to the collecting apparatus after insertion of the vault therein.

2. Description of the Prior Art

Typically, each coin and/or token collecting apparatus, such as an automatic toll booth or station used along highways, or at tunnels, bridges, parking lots and the like, utilizes a vault or storage device to store received coins and/or tokens. For example, as illustrated in FIG. 1A, a toll booth 10, which is typically located adjacent a roadway and mounted on top of a raised portion or island 14, generally includes a basket or coin hopper 16, a removable vault 18 and a vault housing 20. The basket 16 is adapted to receive coins and/or tokens from motorists and to supply them to the vault housing 20 which, in turn, causes a determination to be made as to whether the correct amount has been received and thereafter causes information relating thereto to be produced. Such determination and production of information may be performed by a processing device (not shown) which may be located within the vault housing 20. The removable vault 18 is adapted to be inserted into the vault housing 20 and, upon such insertion, is further adapted to receive the coins and/or tokens therefrom. Upon removing the vault 18 from the housing 20, the coins and/or tokens are securely held inside, as hereinafter more fully described. The housing 20 may include a coin and/or token sensing and/or testing apparatus as described in U.S. Pat. Nos. 4,845,994 and 5,097,934, which have a common assignee with the present application and which are hereby incorporated by reference.

A rear view of a vault 18 in accordance with the prior art is shown in FIG. 2. Vault 18 includes a lid 28 located on a top portion of the vault having a rotatable openable/closeable portion 38, a connector 24 located in a recess portion 25 of a back surface 36, a plurality of guide holes 22 located on the back surface, a handle 39 located on the back surface and a handle (not shown) located on a front surface 46 for facilitating the handling of the vault, and guide rails 40 located on sides 42 and 44.

As shown in FIG. 3, the housing 20 includes an opening 120 large enough to accommodate the vault 18, guide rails 140 located on sides 142 and 144 which are adapted to be in contact with guide rails 40 of the vault 18 (FIG. 2) during insertion or removal of the vault, and guide pins 122 and a mating connector 124 having contacts 126 located on a back surface 146 inside the opening 120.

During insertion of the vault 18 into the housing 20, the respective ones of the guide rails 40 and 140 are in slidable contact with each other so as to facilitate the insertion of the vault. When such insertion is nearly complete, the guide holes 22 on the back surface 36 of the vault 18 (FIG. 2) receive guide pins 122 (FIG. 3) so as to ensure proper alignment of the connector 24 (FIG. 2) with its corresponding mating connector 124 on the housing 20 (FIG. 3). Further, during such insertion of the vault 18, a pin 48 or similar type device, located on the portion 38 engages a mating member (not shown) located on the housing 20 so as to cause the portion 38 to be pivoted opened, thereby producing an opening (not shown) in the lid 28 of the vault. This opening aligns with a corresponding opening (not shown) in the housing 20 which enables coins and/or tokens to be supplied from the housing into the vault 18.

During removal of the vault 18 from the housing 20, like during the insertion thereof, the respective ones of the guide rails 40 and 140 are in slidable contact with each other so as to facilitate the removal of the vault. During such removal or disconnection, the pin 48 is disengaged from the mating member (not shown) on the housing 20, whereupon the portion 38 is automatically closed, thereby securing the coins and/or tokens stored inside. Such closing of the portion 38 may be accomplished by utilizing springs (not shown) coupled between the portion 38 and an inside portion of the lid 28. That is, upon inserting the vault 18 into the housing 20, the pin 48 engages its mating member located on the housing 20 causing the portion 38 to open and the spring to stretch which, in turn, exerts a force on the portion 38 which is resisted by the pin pressing against its mating member. However, when the vault is removed from the housing 20, the pin 48 no longer engages its mating member and, as a result, the spring returns to its normal unstretched position, thereby closing and locking the portion 38.

After the vault 18 is removed from housing 20, the lid 28 may be opened by an authorized person using a key inserted into a key slot (not shown) located in the vault so as to provide access to the coins and/or tokens contained inside the vault 18. After the lid 28 is closed, a locking mechanism (not shown) is activated. Typically, before the vault is inserted into the vault housing 20, the lid 28 is closed and locked using the locking mechanism.

Each connector 24 on each vault is constructed such that when mated with the mating connector 124, a unique signal, which represents the serial number assigned to the respective vault, may be provided to the vault housing 20. More specifically, contacts 26 (FIG. 2) in the connector 24 may be uniquely connected together by using, for example, jumper wires between predetermined contacts so as to result in a unique connection arrangement between contacts. Alternatively, selective one(s) of the contacts 26 in the connector 24 may be removed so as to produce a unique pattern of removed or remaining contacts. In either situation, after connectors 24 and 124 are mated together, the housing 20 supplies a signal having a known value from connector 124 through connector 24 and back to connector 124. Due to the unique contact arrangement in the connector 24, the signal received back at the vault housing is unique to the respective vault.

As previously mentioned, the vault housing 20 may produce information relating to the received coins and/or tokens. Such information may include the number of each type of coins and tokens and the total dollar amount of all received coins and tokens. The housing 20 may incorporate such produced information with the vault serial number information obtained from the connector 24 and supply such incorporated information by way of radio waves, data lines, telephone lines or similar such transmission paths to a central computer (not shown). Thus, such information from each housing 20 of each of a plurality of toll booths is formed and supplied to the central computer, whereupon the received information is processed and stored in a predetermined manner.

Thus, upon properly inserting the vault 18 into the vault housing 20, the portion 38 on the lid 28 rotatably opens and the connector 24 provides an indication of the vault serial number to the vault housing. Thereafter, when a motorist deposits coins and/or tokens into the basket 16, these coins and/or tokens are determined to be genuine or counterfeit, counted, and supplied to the vault 18. In addition, information relating to how much money and the type of money which was deposited into each vault is maintained and supplied to the central computer. Such information may be printed out by a printer (not shown), or similar means, so as to provide a record of this information.

In order to provide traceability information regarding the handling of each vault, log sheets are utilized. For example, a person responsible for the insertion or removal of the vault 18 into or from the vault housing 20, respectively, typically records the serial number of the vault (which is usually written or stamped onto the vault) onto a log sheet along with other relevant information, such as, the date and time, an identification number of the toll booth, the person's name who is handling the vault and so forth. After removal of the vault from the toll booth, the vault is typically stacked along with numerous other vaults and thereafter transported to a facility, such as a bank, whereupon the log sheets are again filled-in as to the serial number of the vaults received and other relevant information.

As is to be appreciated, during the stacking of the vaults and the transportation thereof, some or all of the contacts 26 contained within the connector 24 may be damaged or broken. Further, even with the use of the guide holes 22 (FIG. 2) and the guide pins 122 (FIG. 3), some or all of the contacts 26 may be damaged or broken during the insertion or extraction of the vault 18 into or from the housing 20, respectively. In any of these situations, if a vault with a damaged or broken connector is thereafter installed into a vault housing, the vault serial number transferred thereto may be erroneous.

Further, the person filling in the log sheets may inadvertently write in the wrong serial number. In such case, accurate and reliable traceability information is not obtained.

Furthermore, although information regarding the coins and/or tokens deposited in a respective vault may be generated by the vault housing 20 and printed out as previously described, such information is not normally transported with the respective vault. In fact, such information may be printed only after a relatively long period of time has elapsed since the vault has been removed, and such printed information is normally forwarded to a central office. Thus, it is often difficult, if not impossible, for someone, such as a bank official, who may currently have possession of a vault to obtain the information generated by the respective vault housing pertaining to the monies inside the vault. As a result, methods, such as weighing the vault, are often employed to obtain an indication of the total monies contained therein. However, as is to be appreciated, the weight of the vault may not provide an accurate and reliable indication of the monies contained therein. Such weight is subject to numerous factors, such as how many of each type of coins or tokens or counterfeit items or other material is contained therein.

Therefore, the prior art has failed to provide a vault for storing coins and/or tokens for use with a coin and/or token collecting apparatus, such as a toll booth, having means for providing information, such as a vault serial number, to a vault housing within the toll booth upon insertion therein which is unlikely to be damaged during insertion, extraction, stacking and transporting of the vault, means for ensuring that the correct vault serial number is provided each time the vault is handled so as to provide more reliable traceability information, and means for receiving and storing information produced by the vault housing 20 which may be readily supplied therefrom.

OBJECTS AND SUMMARY OF THE INVENTION

An object of the present invention is to provide a vault for storing coins and/or tokens which overcomes the problems associated with the prior art.

More specifically, it is an object of the present invention to provide a vault for storing coins and/or tokens for use with a coin and/or token collecting apparatus which contains a memory device having a serial number relating to the respective vault stored therein.

Another object of the present invention is to provide a vault for storing coins and/or tokens as aforementioned which automatically supplies the vault serial number information stored within the memory device to the collecting apparatus upon completion of proper insertion therein.

It is still another object of the present invention to provide a vault for storing coins and/tokens as aforementioned wherein information relating to the received coins and/or tokens and other information may be written into the memory device and read therefrom while the vault is properly inserted into the collecting apparatus.

Yet another object of the present invention is to provide a vault for storing coins and/or tokens as aforementioned which enables the vault serial number and other information stored within the memory device to be readily read therefrom when the vault is not inserted into the coin and/or token collecting apparatus.

In accordance with an aspect of this invention, an apparatus is provided which is insertable into a coin and/or token collecting device for storing coins and/or tokens therein. The apparatus includes a vault having a portion which is openable upon insertion into the collecting device and closeable upon removal therefrom so as to enable the coins and/or tokens to be received and stored therein. The apparatus further includes memory means for storing information including information relating to the apparatus and for supplying the apparatus information to the collecting device upon insertion of the apparatus into the collecting device.

Other objects, features and advantages according to the present invention will become apparent from the following detailed description of the illustrated embodiments when read in conjunction with the accompanying drawings in which corresponding components are identified with the same reference numerals.

BRIEF DESCRIPTION OF THE DRAWINGS

FIG. 3 is a perspective view of a conventional vault housing in which the vault of FIG. 2 may be inserted;

FIG. 5 is a perspective view of a vault housing according to an embodiment of the present invention in which the vault of FIG. 4 may be inserted;

FIGS. 9A, 9B and 9C are charts to which reference will be made in explaining the operations of the vault and/or bag of the present invention.

DETAILED DESCRIPTION OF THE PREFERRED EMBODIMENTS

Figure 4:
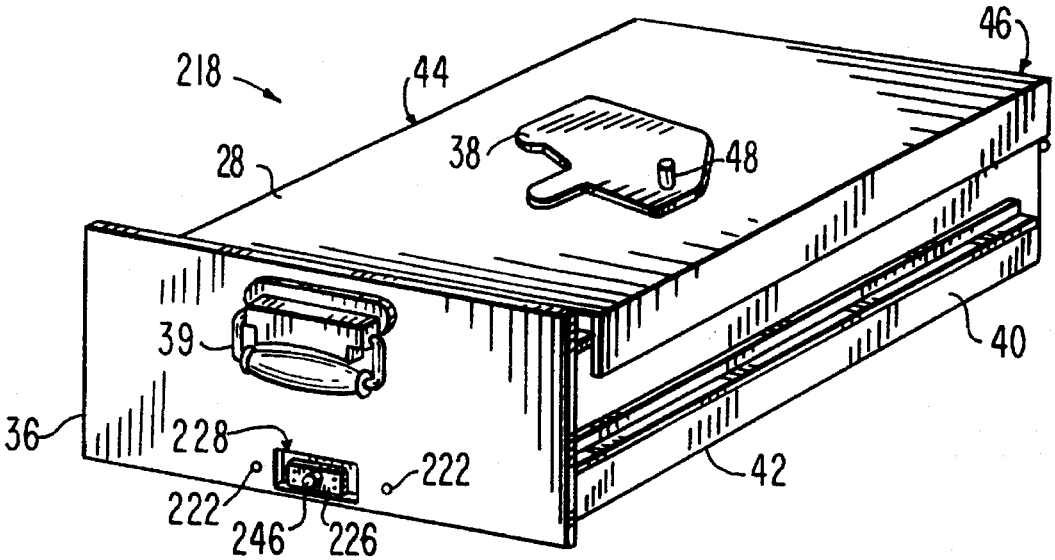
FIG. 4 is a perspective view of a vault according to an embodiment of the present invention.

FIG. 4 illustrates a vault 218 in accordance with an embodiment of the present invention. As shown therein, the vault 218, like the vault 18, includes a lid 28 located on a top portion of the vault having a portion 38 with a pin 48 which is openable to provide access to the inside of the vault and closeable due to springs (not shown), two handles 39 located on the front and back surfaces 46 and 36, respectively, and guide rails 40 located on sides 42 and 44. These elements are substantially the same and/or function in substantially the same manner as those of the previously described vault 18 and, in the interest of brevity, a further explanation thereof is omitted herein.

Vault 218 further includes a plurality of guide holes 222 located on the back surface 36 and a memory apparatus 226 having an eletronic memory device 246 located in a recess portion 228 on the back surface 36. The memory device 246 is preferably of the type sold as "Touch Memories" manufactured by the Dallas Semiconductor Corporation, such as model Nos. DS 1992 and DS 1993. Such memory device 246 preferably includes a read only memory (ROM) and a random access memory (RAM). The memory device 246 is adapted to store information relating to the memory, such as identification or serial number information, in its ROM and information relating to the vault 218, such as identification or serial number information, in its RAM. Upon being contacted by an appropriate "touching" device, such as a vault housing guide block or probe assembly 324 (FIG. 5), as hereinafter more fully described, the memory device 246 is further adapted to supply the requested information from either or both of its ROM or RAM, and also to receive information for storage in its RAM.

Figure 7A:
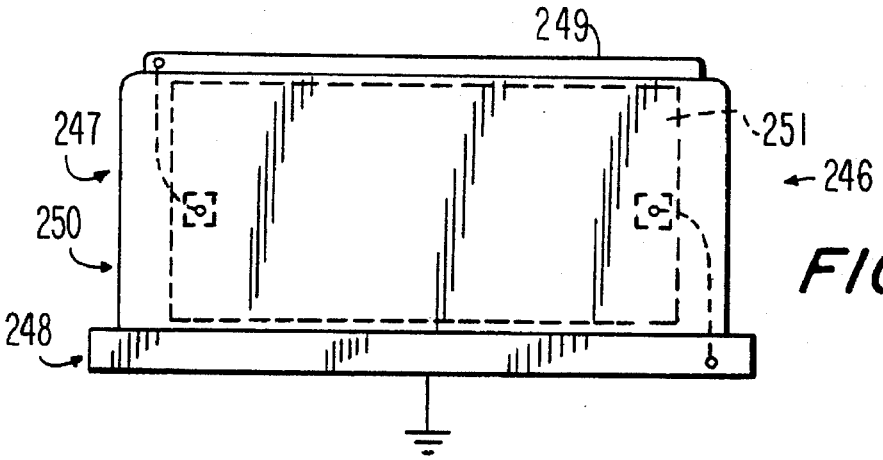
FIG. 7A illustrates a memory device for use with the vault of FIG. 4.

As shown in FIG. 7A, the memory device 246 generally comprises a housing 250, having a cover 247, a base portion 248, and a touching portion or surface 249, and a memory chip 251 contained within the housing. The base portion 248, which is grounded, is connected to a ground connection of the memory chip. The touching portion or surface 249 is connected to the memory chip. The outer surface of the memory device 246 is relatively smooth. The memory device 246 has a relatively small size and is constructed so as to withstand anticipated environmental conditions, such as temperature, shock and water or saline exposure.

Figure 7B:
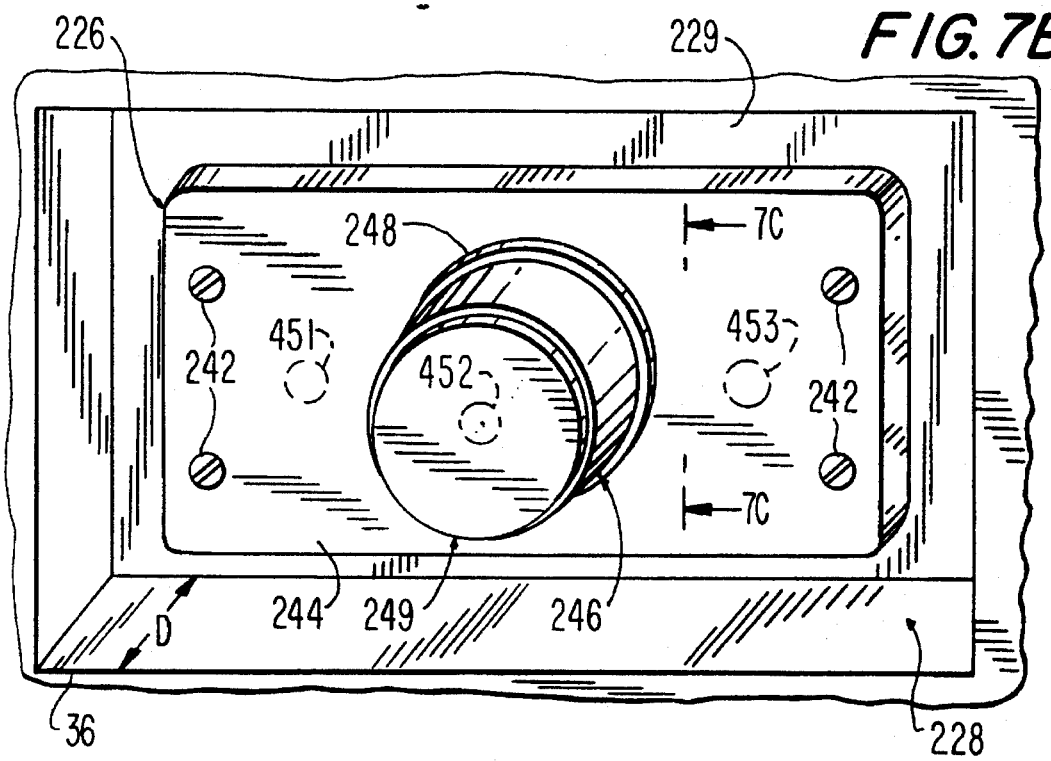
FIG. 7B illustrates a portion of the vault of FIG. 4.
Figure 7C:
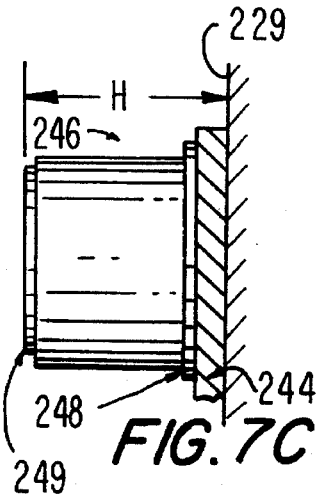
FIG. 7C illustrates a partial sectional view taken through the portion of FIG. 7B.

The memory device 246 is securely mounted onto a plate member 244 which, in turn, is secured by a plurality of screws 242 to a back wall 229 of the recess portion 228, as shown in FIG. 7B. The recess portion has a minimum insertion-type depth D which is greater than a maximum height H (FIG. 7C) of the memory apparatus 226.

Figure 2:
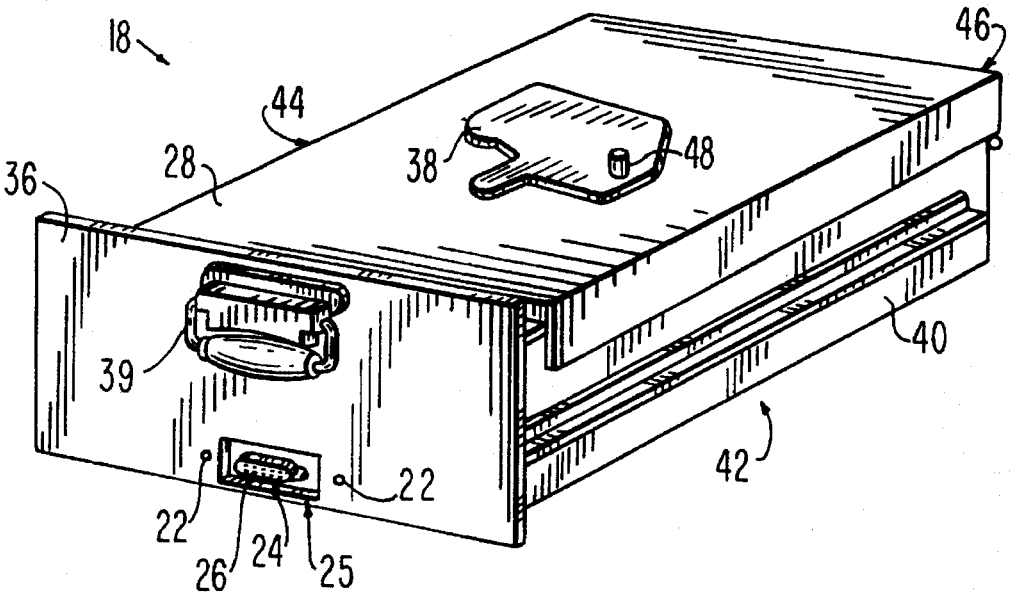
FIG. 2 PRIOR ART
FIG. 2 is a perspective view of a conventional vault.

Therefore, unlike the connector 24 used with the vault 18 (FIG. 2), the memory apparatus 226 does not rely upon a multiplicity of connector contacts which may be damaged or broken. Similarly, unlike the connector 124 used with the vault housing 20, the vault housing 320 does not rely upon a multiplicity of insertion type connector contacts which may be easily damaged or broken. Further, since the memory apparatus 226 is mounted within the recess portion 228 as previously mentioned, most objects, such as other vaults, contacting the back surface 36 of the respective vault will only contact the back surface and/or the handle 39 on the back surface and will not contact the memory apparatus 226 and the memory device 246. Thus, the memory device 246, as compared to the connector 24, is unlikely to be damaged during insertion, extraction, stacking, and/or transporting of the vaults.

Figure 1A:
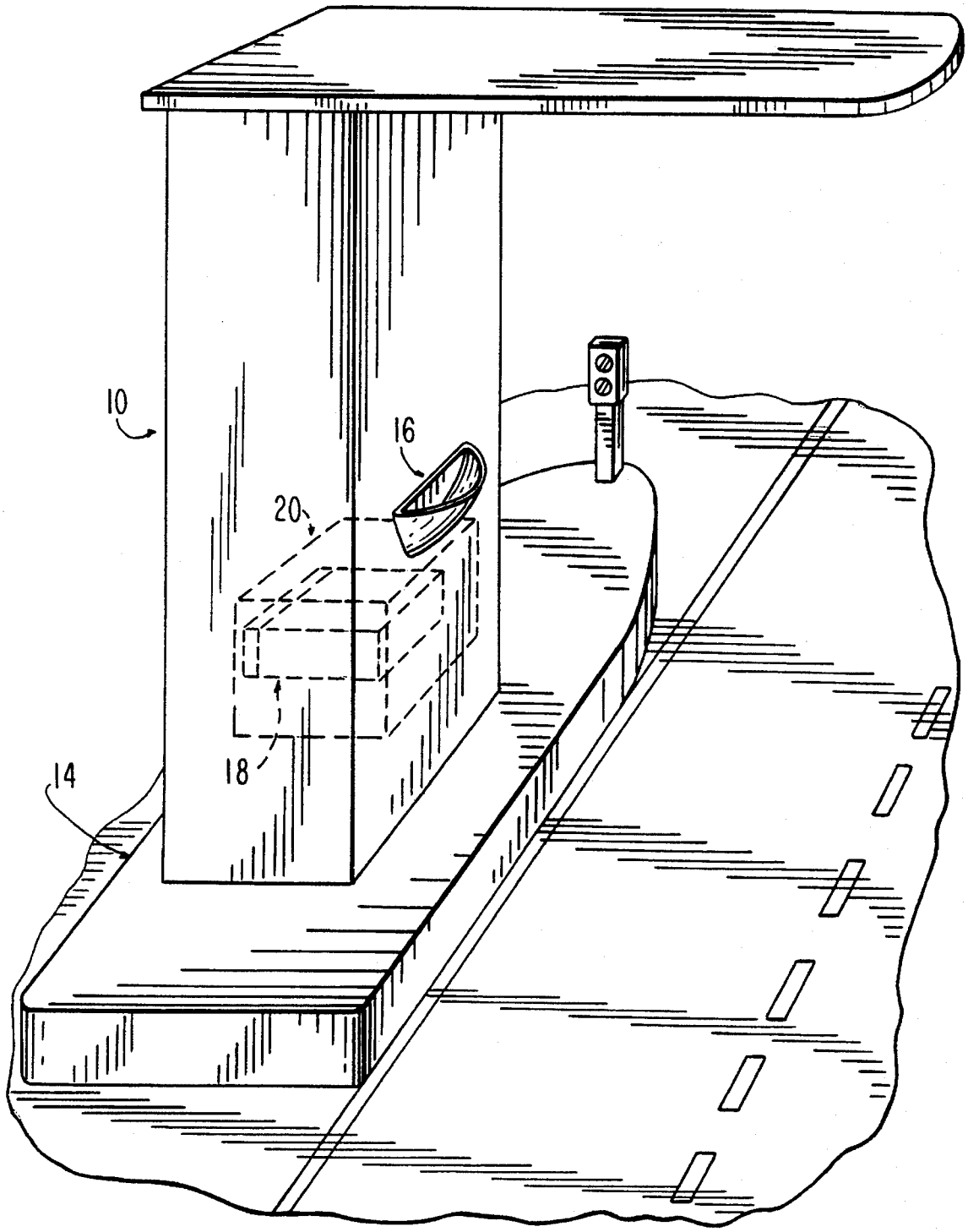
FIG. 1A PRIOR ART
FIG. 1A is a perspective view of a conventional toll booth.
Figure 1B:
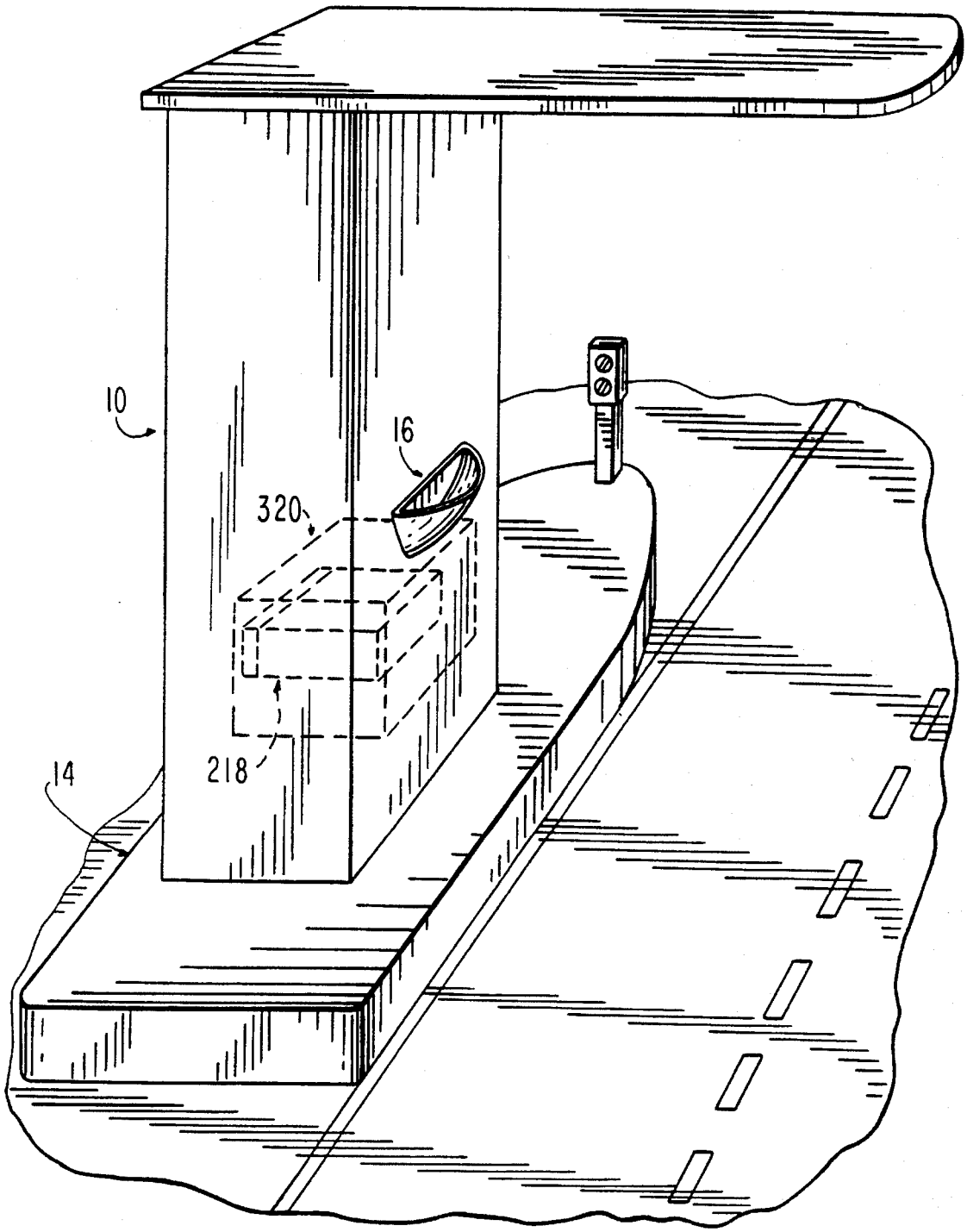
FIG. 1B is a perspective view of a toll booth in which the present invention may be utilized.

In a manner similar to the arrangement between the vault 18 (FIG. 2) and the vault housing 20 (FIG. 3), the vault 218 (FIG. 4) is insertable into a vault housing 320 (FIG. 5) which, in turn, may be used with a toll booth 10 (FIG. 1B). Further, as shown in FIG. 5, the vault housing 320, like the vault housing 20, includes an opening 120, and guide rails 140 located on sides 142 and 144. These elements are substantially similar to and function in substantially the same manner as those of the vault housing 20 (FIG. 3) and, accordingly further explanation thereof is omitted herein. Additionally, the vault housing 320 includes a number of guide pins 322, which number equals the number of guide holes 222, which are located on a back wall 146 inside the opening 120.

Figure 6:
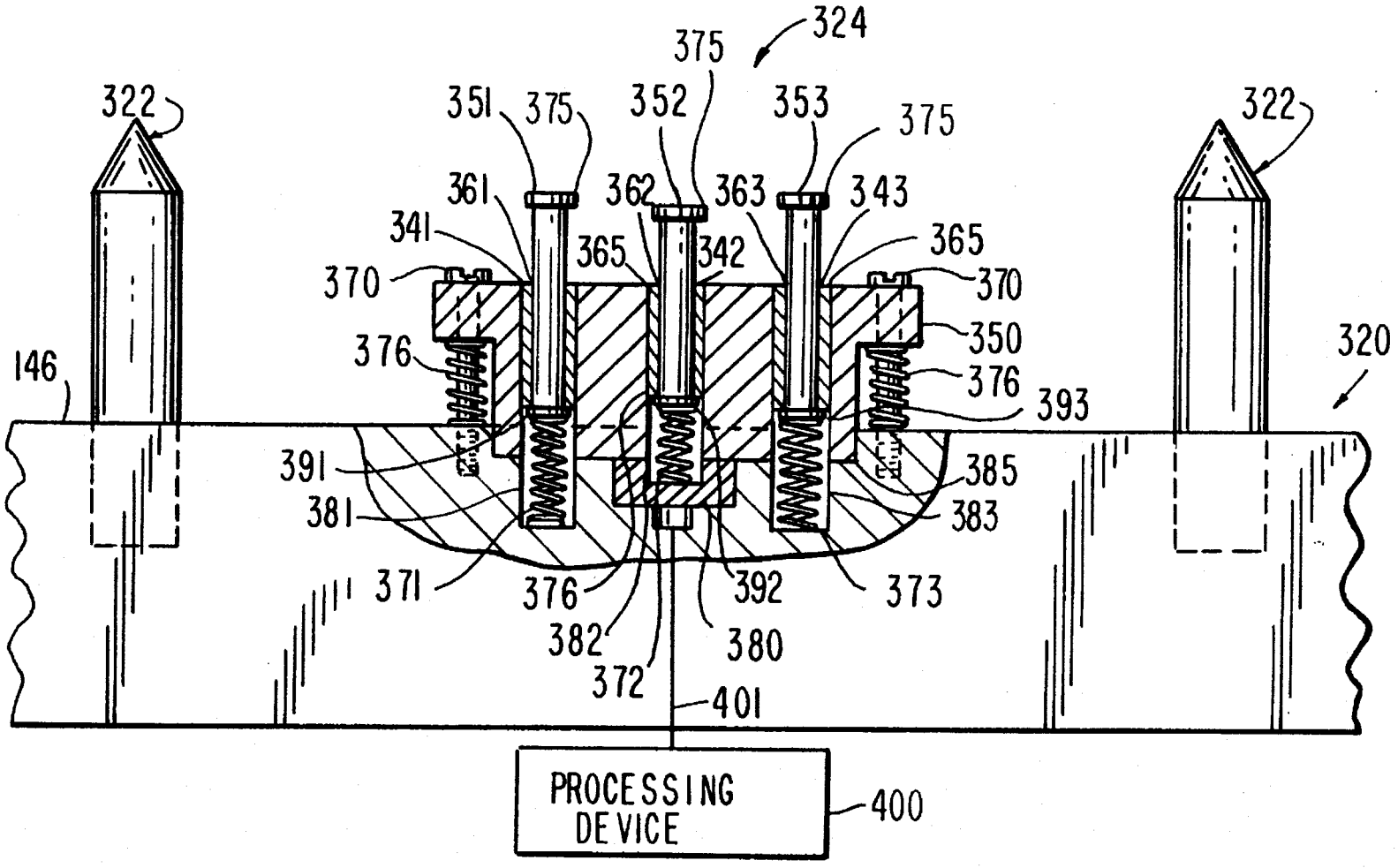
FIG. 6 illustrates a portion of the vault housing of FIG. 5.

Unlike the vault housing 20, the vault housing 320 includes the probe assembly 324. As shown in FIG. 6, such probe assembly generally includes three contact pins 351, 352 and 353; three springs 371, 372 and 373, such as compression-type springs; a contacting member 380; and a block 350. The block 350 is secured within a recessed portion 385 of the back wall 146 of the vault housing 320 and fastened to the back wall by a plurality of screws 370.

The block 350 includes three holes 361, 362 and 363 each extending through the block and each having a sleeve 365. The back wall 146 includes holes 381 and 383 which are respectively aligned with holes 361 and 363 of the block 350. The contacting member 380 includes a hole 382 which is aligned with the hole 362 in the block 350. Each of the contact pins 351, 352 and 353, which may be completely or partially gold-plated, includes an upper lip or retaining member 375 and a lower lip or retaining member 376. Each of the contact pins 351, 352 and 353 are arranged inside the respective one of the sleeves 365 and secured therein by use of the upper and lower lips 375 and 376. That is, the upper and lower lips 375 and 376 of the pins 351, 352 and 353 are respectively adapted to contact upper surfaces 341, 342 and 343 and lower surfaces 391, 392 and 393 of the pins 351, 352 and 353, so as to limit the travel of the pins. The springs 371, 372 and 373 are respectively arranged inside holes 361/381, 362/382 and 363/383 so as to contact the lower lips 376 of the pins 351, 352 and 353. Additionally, springs 371 and 373 are respectively arranged so as to contact a surface of the back wall 146 located at the bottom of the holes 381 and 383, and spring 372 is arranged so as to contact a surface of the contacting member 380 located at the bottom of the hole 382.

The contacting member 380 is connected to a processing device 400 by way of a wire 401 as shown in FIG. 6. The contacting member 380 is adapted to receive data from the memory device 246, whereupon such data is transferred from the memory device through the contacting member to the processing device 400. The contacting member is further adapted to transfer data from the processing device 400 to the memory device 246.

The probe assembly 324 is arranged on the back wall 146 of the vault housing 320 such that when the vault 218 is inserted into the vault housing, each of the contact pins 351, 352 and 353 is aligned with a respective area of the memory apparatus 226. That is, the contact pins 351, 352 and 353 are respectively aligned with contact areas 451, 452 and 453 of the memory apparatus illustrated in FIG. 7B. As previously mentioned, each of the pins 351, 352 and 353 contacts a respective spring, thereby making each of the pins spring-loaded. As a result, when the vault is inserted into the vault housing 320, all of the pins contact their respective contact areas on the memory apparatus 226.

Areas 451 and 453 are located on the plate member 244 which is connected to the back wall 229 of the vault 218, as previously described. The contact pins 351 and 353, and springs 371 and 373, like the back wall 146, are preferably fabricated from a material or materials which are electrically conductive. Accordingly, when contact pins 351 and 353 respectively contact areas 451 and 453, a ground connection is provided to the plate member 244. Since the base portion 248 of the memory device 246 is mounted on the mounting plate 244 and since a connection is provided between a ground connection of the memory chip contained within the memory device 246 and the base portion as previously described, a ground connection is provided to the memory chip.

The area 452 is located on the touching portion 249 of the memory device 246. Like the contact pins 351 and 353 and springs 371 and 373, the pin 352 and the spring 372 are preferably fabricated from an electrical conductive material or materials. This enables data transmission between the memory device 246 (FIG. 7) and the processing device 400 (FIG. 6) by way of the contact pin 352, spring 372, contacting member 380 and the wire 401, as hereinafter more fully described.

As previously mentioned, the memory device 246 is preferably one of the Touch Memories manufactured by the Dallas Semiconductor Corporation. A description of such Touch Memories and an explanation of the operation thereof is provided in two brochures distributed by the Dallas Semiconductor Corporation respectively entitled "Book of DS199x Touch Memory Standards", October 1992, and "Touch Memory", second edition, which are both hereby incorporated by reference.

As described in the above-mentioned brochures, bidirectional communication between the memory device 246 and the processing device 400 may be accommodated by utilizing a so-called 1-wire protocol. That is, such communication may be effected by using a ground connection and a single or 1-wire data line. The ground connection is provided to the memory chip contained within the memory 246, as previously described. The single or 1-wire data line is provided by the path including the contact pin 352, spring 372, contacting member 380 and wire 401.

The transfer of data in such 1-wire arrangement is performed serially in a bit-asynchronous manner and in a half-duplex mode within discrete time slots. The processing device 400 initiates each transfer of data by sending a command to the memory device 246. Thereafter, data transfer may commence. As an example, the processing device 400 may cause the data line to be "pulled" from a relatively high value (such as 1) to a relatively low value (such as 0), thereby producing a slope. A predetermined time after this slope, data is transferred for reception by either the processing device 400 or the memory 246. Such slope may also be utilized to provide synchronization between the processing device 400 and the memory device 246. A cyclic redundancy check (CRC) may also be utilized to improve the reliability of the data transfer.

A discussion of the operation of the vault 218 (FIG. 4) with the memory device 246 (FIGS. 7A–C) and the vault housing 320 (FIG. 5) with the probe assembly 324 will now be presented.

Upon inserting the vault 218 into the vault housing 320, the guide holes 222 receive guide pins 322 so as to insure proper alignment of the memory apparatus 226 with the probe assembly 324. After proper insertion of the vault 218 into the vault housing 320 (that is, a ground connection is established and the touching portion 249 is contacted), requested information, such as the serial number of the vault may be read from the RAM of the memory device 246 and supplied to the processing device 400 of the vault housing 320. The processing device 400 combines the vault serial number information with the generated information relating to the received coins and/or tokens in a manner similar to that performed in the vault housing 20. Thereafter, the processing device 400 may supply the generated information, with the serial number information incorporated therein, to the probe assembly 324, whereupon such information is written into the RAM of the memory 246. Other data or information may also be transferred between the processing device 400 and the memory device 246.

After removal of the vault 218 from the device 320, the information stored in the memory 246 is available to be read out by utilizing a device, such as a portable hand-held device, having a memory interface probe similar to that of the probe assembly 324. The read out information may be processed by use of such portable device or may instead be supplied to a processing device for processing thereat. Further, with the use of such portable device, additional information may be written into the RAM of the memory 246. Such portable device operates in a manner similar to that of the probe assembly 324 and processing device 400 so as to be compatible with the memory device 246 and, accordingly a further explanation thereof is omitted.

Thus, a person, such as the bank official, who has the vault in his or her possession and who, for example, needs to know the number of coins and tokens supplied to the vault or the total dollar amount contained therein so as to verify the count performed at the bank, merely has to "touch" or contact the memory 246 with the probe of the portable device in a manner similar to that previously described. As a result, the desired information, which is stored within the RAM of the memory 246, is read out and supplied to the portable device, which may contain a display, whereupon the read information may be displayed therein. Alternatively, the portable device may be coupled to a printer so that the read information may be printed therefrom.

Further, traceability information may be obtained by having each person who handles the vault 218 input information, such as the handler's name or identification number and the time and date, into the RAM of the memory 246 by using the portable device. Additionally, the vault identification number may be read from the memory 246 and either stored within a memory contained in the handler's portable device to be read out at a later time and supplied to a central office or automatically supplied by way of a transmission path, such as radio waves, to the central office. Accordingly, an accurate traceability record is maintained in the RAM of the memory 246 and is also supplied to the central office.

Thus, the present invention provides a vault having a memory device for storing information including a vault serial number which, upon insertion into a toll booth, is supplied to the toll booth. Due to the construction and size of the memory device, the memory device is not apt to be damaged during insertion, extraction, stacking, and/or transporting of the vaults. Further, information generated by the toll booth may be written into the memory device, thereby enabling such information to be transported with the vault. Furthermore, the memory device enables accurate traceability information to be stored therein and/or supplied to a central office.

Figure 8:
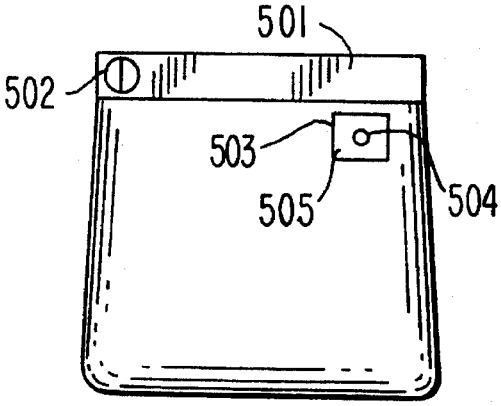
FIG. 8 illustrates a bag according to an embodiment of the present invention.

Although a preferred embodiment of the present invention has been described for use with a toll booth, the present invention is not so limited and may be utilized in any coin and/or token collecting apparatus, such as those utilized in pedestrian turnstiles, amusement games and so forth. Further, in another embodiment, the present invention may be utilized with lockable storage or collection bags, such as a money collection bag 500 illustrated in FIG. 8. Bag 500 includes a lockable closure 501 which may be opened by means of a key inserted into keyslot 502. A tag 503 having a memory device 504 is attached to the bag 500 by way of a fastener 505. The memory device 504 is similar to the memory device 246 and operates in a similar manner. As with the memory 246 of the vault 218, the memory device 504 enables information, such as serial number and traceability information, to be stored therein and read therefrom.

FIGS. 9A, 9B and 9C are charts which describe operations which may be performed with the vault 218 or the bag 500. More specifically, FIGS. 9A, 9B and 9C respectively describe operations which may be performed when the vault or bag is removed from a collection site, when the vault or bag is transported from the collection site to another site, and when the money contained within the vault or bag is counted. The description provided in the charts of FIGS. 9A–9C, especially when read in conjunction with the above-description relating to the vault 218 and the bag 500, are believed to be self-explanatory and, accordingly no further explanation is provided herein.

Although preferred embodiments of the present invention and modifications thereof have been described in detail herein, it is to be appreciated that this invention is not limited to these precise embodiments and modifications, and that other modifications and variations may be affected by one skilled in the art without departing from the spirit and scope of the invention as defined by the amended claims.

What is claimed is:

1. An apparatus insertable into a coin and/or token collecting device for storing said coins and/or tokens therein, said collecting device being in communication with a central computer for transferring information relating to said apparatus and information concerning the operation of said collecting device directly to said central computer, said apparatus comprising:

a vault having a portion which is openable upon insertion into said collecting device and closeable and lockable upon removal therefrom so as to enable said coins and/or tokens to be received and stored therein;

electronic memory means including a touch memory device for storing information including the apparatus information and for supplying the apparatus information to said collecting device and to said central computer upon insertion of said apparatus into said collecting device, said touch memory device having a maximum height and being located in a recess portion on an outer surface of said vault and wherein said recess portion has a depth having a value at least equal to said maximum height.

2. An apparatus for storing coins and/or tokens according to claim 1, wherein said apparatus information includes a unique identification number utilized for identifying said apparatus.

3. An apparatus for storing coins and/or tokens according to claim 1, wherein said touch memory device includes a random access memory for storing therein said apparatus information.

4. An apparatus for storing coins and/or tokens according to claim 3, wherein said random access memory further stores therein information received from said collecting device including information relating to the amount of said coins and/or tokens stored in said vault after insertion of said apparatus into said collecting device.

5. An apparatus for storing coins and/or tokens according to claim 1, wherein said touch memory device further includes a read only memory for storing therein information relating to said memory means.

6. An automatic toll booth operable for collecting coins and/or tokens, said automatic toll booth having a transferring apparatus being in communication with a central computer for transferring information including information concerning the operation of said automatic toll booth directly to said central computer, said automatic toll booth comprising:

hopper means for receiving said coins and/or tokens;

means for receiving said coins and/or tokens from said hopper means, and means for counting said coins and/or tokens and for generating information relating thereto;

a vault having a lockable portion which is openable so as to receive said coins and/or tokens from the counting and generating means, and including electronic memory means having a touch memory device for storing information including information relating to said vault;

means receiving said vault for automatically reading the vault information from said memory means upon receipt of said vault and for supplying the read vault information to said counting and generating means and through the transferring apparatus to said central computer, said touch memory device having a maximum height and being located in a recess portion on an outer surface of said vault and wherein said recess portion has a depth having a value at least equal to said maximum height.

7. An automatic toll booth according to claim 6, wherein said touch memory device includes a random access memory for storing therein said vault information.

8. An automatic toll booth according to claim 7, wherein said means for automatically reading and supplying includes means for supplying the generated information relating to the counted coins and/or tokens from said counting and generating means to said random access memory of said touch memory device.

9. An automatic toll booth according to claim 6, wherein said touch memory device further includes a read only memory for storing therein information relating to said memory means.

10. A coin and/or token collecting apparatus being in communication with a central computer for transferring information including information concerning the operation of said apparatus directly to said central computer, said apparatus comprising:

hopper means for receiving coins and/or tokens, and means for counting said coins and/or tokens and for generating information relating thereto;

a vault having a portion which is openable so as to receive said coins and/or tokens from the counting and generating means, and including memory means having a touch memory device for storing information including information relating to said vault; and means receiving said vault for automatically reading the vault information from said memory means upon receipt of said vault and for supplying the read vault information to said counting and generating means and to said central computer, said touch memory device having a maximum height and being located in a recess portion on an outer surface of said vault and wherein said recess portion has a depth having a value at least equal to said maximum height.

11. A coin and/or token collecting apparatus according to claim 10, wherein said touch memory device includes a random access memory for storing therein said vault information.

12. A coin and/or token collecting apparatus according to claim 11, wherein said means for automatically reading and supplying includes means for supplying the generated information relating to the counted coins and/or tokens from said counting and generating means to said random access memory of said touch memory device.

13. A coin and/or token collecting apparatus according to claim 12, wherein said touch memory device further includes a read only memory for storing therein information relating to said memory means.

14. An apparatus insertable into a coin and/or token collecting device for storing said coins and/or tokens therein, said collecting device being in communication with a central computer for transferring information relating to said apparatus and information concerning the operation of said collecting device directly to said central computer, said apparatus comprising:

a vault having a portion which is openable upon insertion into said collecting device and closeable and lockable upon removal therefrom so as to enable said coins and/or tokens to be received and stored therein; and electronic memory means including a touch memory device for storing information including the apparatus information and for supplying the apparatus information to said collecting device and to said central computer upon insertion of said apparatus into said collecting device.

15. In a toll booth having basket means for receiving coins and/or tokens, means receiving said coins and/or tokens from said basket means for counting said coins and/or tokens and for generating information relating thereto, a vault having a lockable portion which is openable so as to receive said coins and/or tokens from the counting and generating means, receiving means coupled to said counting and generating means for receiving said vault, said means being in communication with a central computer for transferring information relating to said vault and information concerning the operation of said toll booth directly to said central computer, the improvement comprising: electronic memory means including a touch memory device coupled to said vault for storing information including the vault information and for automatically supplying the vault information to the vault receiving means and through the transferring means to said central computer upon insertion of said vault into said vault receiving means.

16. An automatic toll booth operable for collecting coins and/or tokens, said automatic toll booth having a transferring apparatus being in communication with a central computer for transferring information including information concerning the operation of said automatic toll booth directly to said central computer, said automatic toll booth comprising:

hopper means for receiving said coins and/or tokens;

means for receiving said coins and/or tokens from said hopper means, and means for counting said coins and/or tokens and for generating information relating thereto;

a vault having a lockable portion which is openable to as to receive said coins and/or tokens from the counting and generating means, and including electronic memory means having a touch memory device for storing information including information relating to said vault; and means receiving said vault for automatically reading the vault information from said memory means upon receipt of said vault and for supplying the read vault information to said counting and generating means and through the transferring apparatus to said central computer.

17. A coin and/or token collecting apparatus being in communication with a central computer for transferring information including information concerning the operation of said apparatus directly to said central computer, said apparatus comprising:

hopper means for receiving coins and/or tokens, and means for counting said coins and/or tokens and for generating information relating thereto;

a vault having a portion which is openable so as to receive said coins and/or tokens from the counting and generating means, and including memory means having a touch memory device for storing information including information relating to said vault; and means for receiving said vault and for automatically reading the vault information from said memory means upon receipt of said vault and for supplying the read vault information to said counting and generating means and to said central computer.

* * * * *